US011020864B2

(12) United States Patent
Spencer et al.

(10) Patent No.: US 11,020,864 B2
(45) Date of Patent: Jun. 1, 2021

(54) HEAD SHAVING DEVICE

(71) Applicants: DeShawn Spencer, Upland, CA (US); Michael Hendricks, Rialto, CA (US)

(72) Inventors: DeShawn Spencer, Upland, CA (US); Michael Hendricks, Rialto, CA (US)

( * ) Notice: Subject to any disclaimer, the term of this patent is extended or adjusted under 35 U.S.C. 154(b) by 0 days.

(21) Appl. No.: 16/798,347

(22) Filed: Feb. 22, 2020

(65) Prior Publication Data

US 2020/0269452 A1 Aug. 27, 2020

Related U.S. Application Data

(60) Provisional application No. 62/809,573, filed on Feb. 23, 2019.

(51) Int. Cl.

| | |
|---|---|
| ***B26B 19/38*** | (2006.01) |
| ***B26B 21/18*** | (2006.01) |
| ***B26B 21/52*** | (2006.01) |
| *B26B 21/44* | (2006.01) |

(52) U.S. Cl.

CPC ..... *B26B 19/3853* (2013.01); *B26B 21/18* (2013.01); *B26B 21/527* (2013.01); *B26B 21/44* (2013.01)

(58) Field of Classification Search

CPC ... B26B 19/3853; B26B 21/527; B26B 21/18; B26B 21/44

USPC ..... 30/43.7–44, 70–71, 77, 81, 296.1, 526, 30/298

See application file for complete search history.

(56) References Cited

U.S. PATENT DOCUMENTS 1,485,214 A * 2/1924 Chance ..... B26B 21/18 30/72
1,496,295 A * 6/1924 Chance ..... B26B 21/18 30/73
1,496,296 A * 6/1924 Chance ..... B26B 21/18 30/73
1,513,454 A * 10/1924 Ferry, Sr. ..... B26B 21/18 30/41
1,572,572 A * 2/1926 Straka ..... B26B 21/18 30/73
1,917,812 A * 7/1933 Robinson ..... B26B 21/527 30/72
2,127,369 A * 8/1938 Ritter ..... B26B 21/18 30/31
2,359,198 A * 9/1944 Bowers ..... B26B 21/18 30/32
2,593,307 A * 4/1952 Edwin ..... B26B 21/18 30/70
2,720,696 A * 10/1955 Wadsworth ..... B26B 19/14 30/41.5
4,037,321 A * 7/1977 Iten ..... B26B 21/18 30/47

(Continued)

*Primary Examiner* — Ghassem Alie
*Assistant Examiner* — Nhat Chieu Q Do
(74) *Attorney, Agent, or Firm* — Ascus IP Law, P.C.

(57) ABSTRACT

A hand-held shaving device includes a blade carrier top and a blade carrier base that cooperate to secure a double-edge razor blade in place. The blade carrier top and the blade carrier base mount onto a shaver base that is designed to be held in a hand of a user. When assembled, the device provides rests that contact a body surface to be shaved and when in contact with the body surface set the razor blade at an optimal shaving angle. A process of shaving comprises contacting the body surface to be shaved and moving the device in a direction of the razor blade edge. The device is designed so that it can be used in either hand.

6 Claims, 2 Drawing Sheets

(56) References Cited

U.S. PATENT DOCUMENTS 4,441,253 A * 4/1984 Sacks ..... B26B 21/18 30/32
5,357,680 A * 10/1994 Monistere ..... B26B 21/525 30/298
6,029,356 A * 2/2000 Sprinkle ..... B26B 21/08 30/298
6,493,950 B1 * 12/2002 Kludjian ..... B26B 21/22 30/298
D542,104 S * 5/2007 Holcomb ..... D7/695
8,726,528 B2 * 5/2014 Lyles ..... B26B 19/3853 30/526
10,137,585 B2 * 11/2018 Gonterman ..... B26B 21/522
10,137,586 B1 * 11/2018 Strong ..... B26B 21/525
10,780,597 B2 * 9/2020 Petersen ..... B26B 21/02
2003/0033717 A1 * 2/2003 Cecil ..... B26B 21/22 30/50
2003/0084573 A1 * 5/2003 Kludjian ..... B26B 21/222 30/50
2013/0255455 A1 * 10/2013 McCue ..... B26B 19/20 83/13
2014/0290066 A1 * 10/2014 Woolfson ..... B26B 21/521 30/50
2015/0040405 A1 * 2/2015 Kulshreshtha ..... B26B 19/3853 30/277.4
2015/0183119 A1 * 7/2015 Contaldi ..... B26B 21/527 132/200
2016/0075040 A1 * 3/2016 Nordstrom ..... B26B 21/18 30/71
2016/0176060 A1 * 6/2016 Kulshreshtha ..... B26B 19/28 30/277.4
2016/0193740 A1 * 7/2016 Phillips ..... B26B 21/527 30/34.05
2017/0297212 A1 * 10/2017 Nordstrom ..... B26B 21/18
2018/0065264 A1 * 3/2018 Gilor ..... B26B 21/18

* cited by examiner

HEAD SHAVING DEVICE

CROSS REFERENCE TO RELATED APPLICATION

This application claims the benefit under 35 U.S.C. § 119(e) of U.S. Provisional Application No. 62/809,573, filed Feb. 23, 2019, and entitled "Head Shaving Device," the entirety of which is hereby incorporated by reference.

FIELD OF THE INVENTION

The invention is in the field of shaving devices, in particular shaving devices that are suited for shaving curved body surfaces such as the scalp.

BACKGROUND

Evidence of shaving devices dates back to the Bronze age, with the oldest razor-like object dating to approximately 18,000 BC. Early forms of razors were fashioned from shells, obsidian and other materials that could be readily formed into an object having a sharp edge.

The first straight razors were developed in England in the 18th and 19th centuries. Typically, these were used by trained barbers to give their customers a quick and thorough shave. With the advent of the safety razor in 1901, it became more convenient for people to manage their own personal grooming, without the need for special training in the use of a shaving implement.

Since that time, a number of designs have been developed. In some the head is made to pivot to follow the contours of the part of the body being shaved. In others, shaving heads have been designed to hold two, three, or even more blades in order to shave as closely as possible without breaking the skin.

It has been, and continues to be, fashionable for people to shave their heads. Shaving the head with conventional safety razors is problematic for several reasons, one of which being that the design of safety razor handles is such that they are optimized for manually shaving what could be thought of as vertically oriented surfaces, such as the face and legs. In prior art razor designs, the longitudinal axes of the handle and cutting portion are oriented substantially perpendicular to each other. While this provide a convenient orientation for shaving the face or legs, it is not optimal for shaving the head, which can be thought of as a horizontally oriented body surface.

There are prior art shaving designs intended for use in shaving the head. For example, U.S. Pat. No. 8,726,528 (Lyles) discloses a portable electric head shaver that includes a cutter head with rotating blades. However, this device is limited in that it is electrically powered thus requiring periodic replacement of batteries or a rechargeable battery. Similarly, the cutter head assembly is mechanically complex. Taken together, this shaver is expensive and difficult to manufacture.

Thus, what is needed is a mechanically simple shaver that is effective to allow a user to shave their head, or other curved body surfaces.

SUMMARY OF THE INVENTION

The present disclosure provides a novel hand-held shaving device that is mechanically simple and provides for comfortable and efficient shaving by setting the razor blade at an optimal angle relative to the body surface being shaved.

In one embodiment, the device comprises a blade carrier top, a blade carrier base, and a shaver base. The blade carrier top and blade carrier base are designed to secure a double-edge safety razor blade in place. These components are then mounted to a shaver base which is designed to fit into the hand of a user. Rests on the blade carrier base and the shaver base are positioned such that when they contact the body surface being shaved, the razor blade is set at an optimal, pre-determined angle, relative to the plane of the body surface at the point of contact.

Thus, what is provided in the present disclosure is a shaving device assembly for shaving a body surface, the assembly comprising: a shaver base, the shaver base comprising: a main body, the main body comprising: an upper shaver base surface, a pair of lateral extensions, a pair of lower extensions, wherein each lateral extension further comprises a shaver base rest, and wherein the lower extensions are configured to cooperatively form a tunnel sized to receive a finger on a hand of a user; a blade carrier top and a blade carrier base, the blade carrier top and blade carrier base configured to secure a safety razor blade in a substantially fixed position, and to be mountable to the shaver base; wherein the blade carrier top further comprises: a plurality of mounting posts, the mounting posts sized and spaced to engage holes in a safety razor blade, and wherein the mounting posts are further sized and spaced to extend through complimentary holes formed in the blade carrier base and into complimentary holes formed in the shaver base, and wherein the mounting posts are effective to secure the blade carrier top and blade carrier base to the shaver base; and notches on each side of the blade carrier top, the notches sized and configured to expose a portion of the sharpened edge of the safety razor blade; wherein the blade carrier base further comprises: a plurality of blade rests, the blade rests configured so that when the safety razor blade is secured between the blade carrier top and blade carrier base, the blade carrier top exerts a force on the safety razor blade that is resisted by the blade rests and which results in flexion of the safety razor blade, with the degree of flexion determined by complimentary curved surfaces on the blade carrier top and blade carrier base respectively, such that when secured in the shaving device the safety razor blade is flexed to a pre-determined angle; a pair of blade carrier rests, one on each side of the blade carrier base, each blade carrier rest configured to cooperate with shaver base rest on the same side of the shaving device to orient an edge of the safety razor blade at a pre-determined angle; and wherein when assembled and in use, the shaving device is configured to orient an edge of the safety razor blade at an optimal angle relative to the body surface to be shaved.

In some embodiments, the optimal angle is between about 15° and about 25°. In some embodiments the optimal angle is about 20°.

In some embodiments, the device is configured to be manipulated with either the right hand or left hand of the user.

In some embodiments, the mounting posts are maintained in place in the holes of the shaver base by friction.

In some embodiments, the mounting posts are maintained in place in the holes of the shaver base by fasteners.

BRIEF DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numerals, and where:

DETAILED DESCRIPTION OF THE INVENTION

The following discussion provides examples of embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed. Those of skill in the art will recognize that the described embodiment are examples of possible configurations of the invention and are not intended to be limiting to the scope of the invention. Accordingly, the drawings and descriptions contained herein are to be regarded as illustrative of the invention as set forth in the accompanying claims.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

Figure 1:
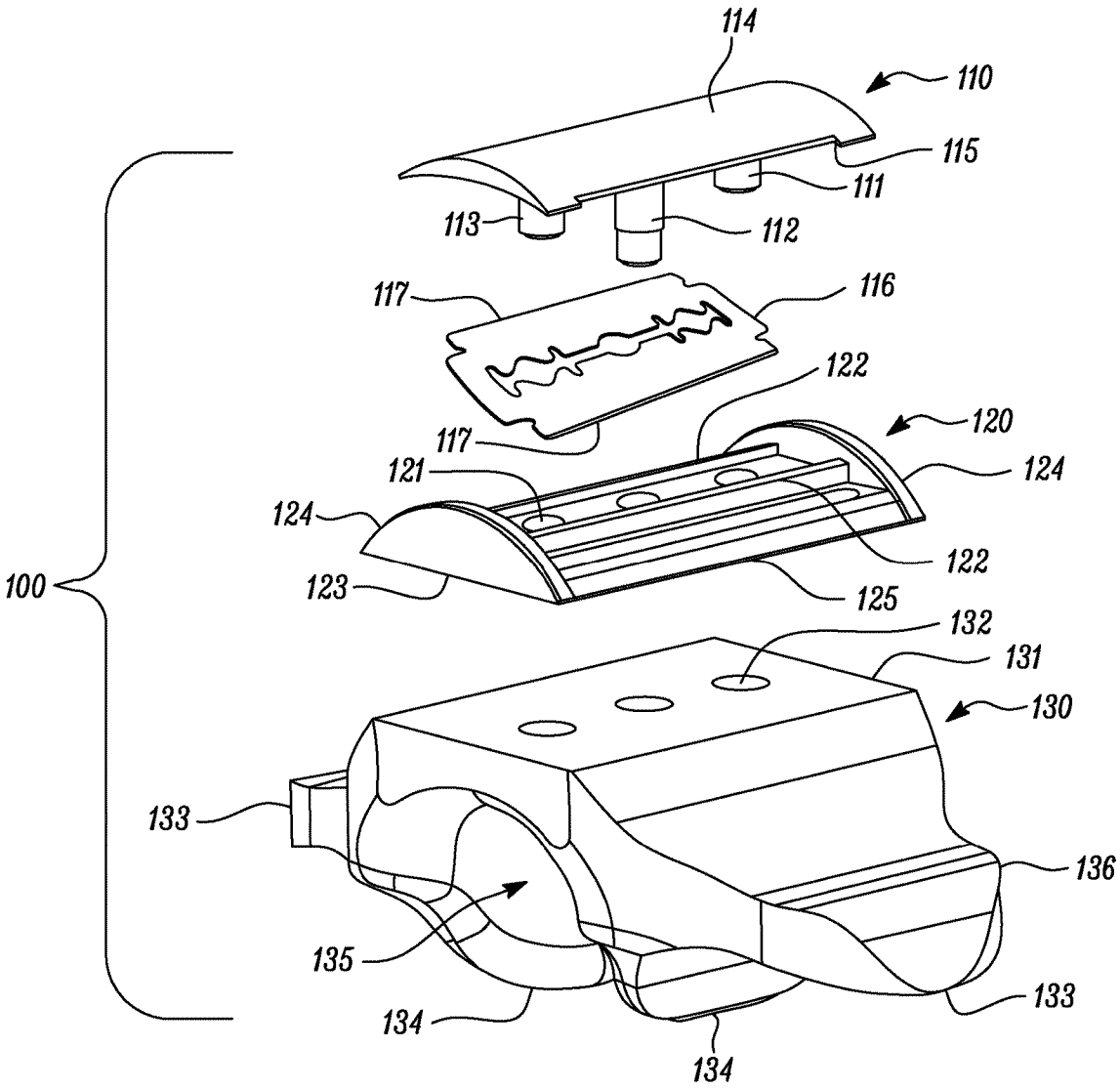
FIG. 1 is an exploded perspective view of an embodiment of a shaving device according to the present disclosure.

The present invention, as described herein and in the accompanying figures comprises a shaving device 100 adapted for shaving curved body surfaces, in particular the scalp. As shown in FIG. 1, an exploded view of an embodiment of a shaving device 100 comprise three major components, a shaver base 130, a blade carrier base 120, and a blade carrier top 110. These, in cooperation with a double-edged safety razor blade 116, are effective to allow a user to shave with the sharpened edges 117 of the razor blade 116 set to an optimal angle (shown as "a" in FIG. 2) relative to the surface being shaved.

A blade carrier top 110 comprises a curved body 114, one or more mounting posts 111, 112, 113 and a notch 115 on either side of the blade carrier top 110. The corresponding notch on the opposite side is hidden in the perspective view shown in FIG. 1. The blade carrier top is configured to engage a blade carrier base 120. When the shaver is assembled and in the ready to use configuration, a razor blade 116 is sandwiched between the blade carrier top 110 and the blade carrier base 120, and the sharpened edges 117 of the razor blade are exposed by the notch 115.

The blade carrier base 120 comprises mounting holes 121 that receive the mounting posts 111, 112, 113, the mounting posts sized such that they extend through the safety razor blade 116, blade carrier base 120 and engage complimentary shaver base holes 132, located in the shaver base 130. The mounting posts may be sized to engage and be secured in the holes in the shaver base by friction, or optionally fasteners may be used to secure the assembled components of the shaving device.

The blade carrier base 120 has a flat undersurface 123 that mounts onto the upper shaver base surface 131 of the shaver base 130 as the shaving device is assembled for use. The blade carrier base further comprises upper curved end surfaces 124 that compliments the curved shape of blade carrier top body 114, such that when assembled the shaver has a snug and compact fit and appearance, as can be appreciated in FIG. 2. The complimentary curved shapes of the blade carrier top 110 and blade carrier base 120 are also effective to impart flexion on the safety razor blade when it is mounted.

Figure 2:
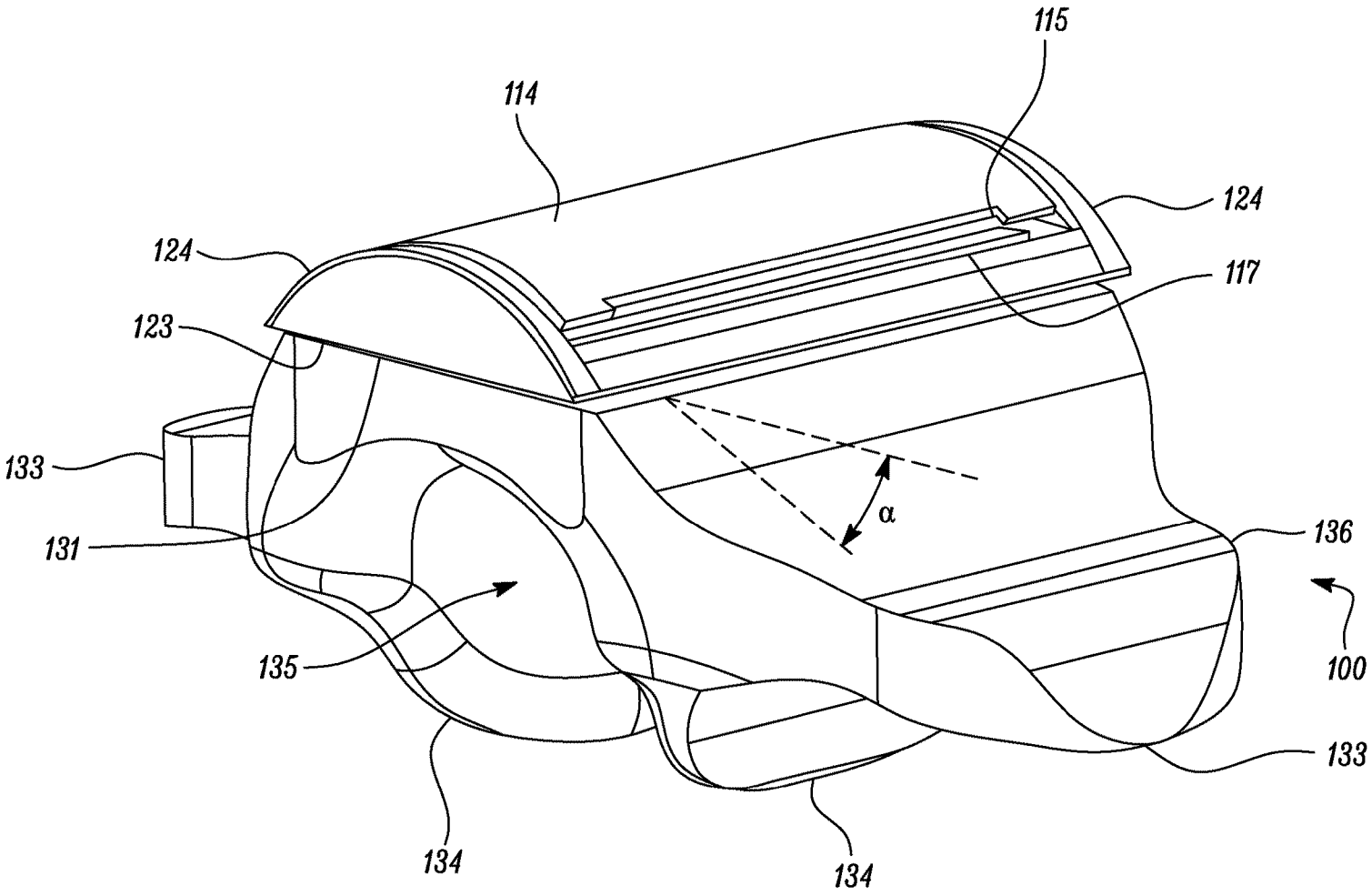
FIG. 2 is a perspective view of an embodiment of an assembled shaving device according to the present disclosure.

The blade carrier base 120 further comprises blade rests 122, onto which the razor blade 116 will be placed prior to securing the razor blade 116 by placing the blade carrier top 110 onto the blade carrier base 120 and fully engaging the top and base as depicted in FIG. 2. When assembled, the razor blade 116 is substantially held in a fixed position, with the razor blade edges 117 exposed. A blade carrier rest 125 provides one point of contact with the body surface during shaving and cooperates with the shaver base rest 136 to set the razor blade at an optimal angle (shown as "a" in FIG. 2). In some embodiments the device can be configured such that the optimal angle is between about 15° and about 25°. In some embodiments, the optimal angle can be about 20°.

The shaver base 130 comprises an upper shaver base surface 131, which as indicated above receives the blade carrier base 120 portion of the device. Also as described above, the shaver base 130 comprises one or more shaver base holes 132, that are configured to receive and engage the posts 111, 112, 113 of the blade carrier top 110. The posts can be sized to fit snugly by friction into the shave base holes 132, or optionally, fasteners like those known in the art can be used to secure the blade carrier top to the shaver base 130 from the bottom of the device.

The shaver base 130 further comprises lateral extensions 133 that extend from the main body of the shaver base 130. These lateral extensions are shaped and sized to include shaver base rests 136, which as described above cooperate with the blade carrier rests 125 to set the razor blade at a predetermined angle when shaving.

The shaver base also comprises a tunnel 135, formed by complimentary lower extensions 134. In one embodiment, a user will insert their middle finger into the tunnel 135 and place their ring finger and index finger outside the tunnel 135 resting on the outer aspect of the lower extensions 134. In this way the shaving device can be held relatively securely and cradled on the palm side of the hand with three fingers providing stability during use. If preferred, the user may hold the device in other ways. The precise way in which the user manipulates the shaver is not limiting to the scope of the invention.

To begin shaving, the user will position the device so that a blade carrier rest 125 and the shaver base rest 136 located on the same side of the device rest upon the body surface to be shaved. The shaving device will then be moved by a user in the direction the corresponding razor blade edge 117 is facing in order to perform the shaving action. Conveniently, the shaving device is bilaterally symmetrical such that a user can place the shaver in either their right hand or left hand and achieve the same results when shaving.

Further, the device makes it easy to change razor blades when the one being used loses its edge and become too dull for comfortable shaving. To replace the blade 116, the user will simply disengage the blade carrier top 110 from the rest of the device, remove the used blade, place a new blade onto the blade carrier base and then reattach and secure the blade carrier top 110 to the blade carrier base 120.

In terms of materials, a wide variety of materials may be used to fashion the components of the present invention. In some cases, the shaving device may be made of wood, plastics, or metals, or combinations thereof. The components of the shaving may also be secured together with the use of fasteners and/or adhesives of various kinds known in the art.

Those of skill in the art will recognizes there are a number of variants that can be fashioned but which incorporated the essential features of the invention as described herein. It will be apparent to those skilled in the art that many more modifications besides those already described are possible without departing from the inventive concepts herein.

What is claimed is:

1. A shaving device assembly for shaving a body surface, the assembly comprising:

a shaver base, the shaver base comprising:

a main body, the main body comprising:

an upper shaver base flat surface, a pair of lateral extensions, a pair of lower extensions, wherein each lateral extension further comprises a shaver base rest, and wherein the lower extensions are configured to cooperatively form a tunnel sized to receive a finger on a hand of a user;

a blade carrier top and a blade carrier base, the blade carrier top and blade carrier base configured to secure a safety razor blade in a fixed position, and to be mountable to the shaver base;

wherein the blade carrier top further comprises:

a plurality of mounting posts, the mounting posts sized and spaced to engage holes in a safety razor blade, and wherein the mounting posts are further sized and spaced to extend through complimentary holes formed in the blade carrier base and into complimentary holes formed in the shaver base, and wherein the mounting posts are effective to secure the blade carrier top and the blade carrier base onto the upper shaver base flat surface of the shaver base; and notches on each side of the blade carrier top, the notches sized and configured to expose a portion of the sharpened edge of the safety razor blade;

wherein the blade carrier base further comprises:

a plurality of blade rests, the blade rests configured so that when the safety razor blade is secured between the blade carrier top and the blade carrier base, the blade carrier top exerts a force on the safety razor blade that is resisted by the blade rests and which results in flexion of the safety razor blade, with a degree of flexion determined by complimentary curved surfaces on the blade carrier top and the blade carrier base respectively, such that when secured in the shaving device assembly, the safety razor blade is flexed to a predetermined angle;

a pair of blade carrier rests, one on each side of the blade carrier base, each blade carrier rest configured to cooperate with a shaver base rest on the same side of the shaving device assembly to orient an edge of the safety razor blade at a pre-determined angle; and wherein when assembled and in use, the shaving device assembly is configured to orient an edge of the safety razor blade at an optimal angle relative to the body surface to be shaved.

2. The shaving device assembly of claim 1, wherein the optimal angle is between 15° and 25°.

3. The shaving device assembly of claim 1, wherein the optimal angle is 20°.

4. The shaving device assembly of claim 1, wherein the device is configured to be manipulated with either the right hand or left hand of the user.

5. The shaving device assembly of claim 1, wherein the optimal angle is 20° wherein the mounting posts are maintained in place in the holes of the shaver base by friction.

6. The shaving device assembly of claim 1, wherein the optimal angle is 20° wherein the mounting posts are maintained in place in the holes of the shaver base using fasteners.

* * * * *